United States Patent [19]

Wilson et al.

[11] Patent Number: 4,850,917

[45] Date of Patent: Jul. 25, 1989

[54] SAILBOARD FIN

[76] Inventors: Kurt D. Wilson, S. Orlando Ave., Cocoa Beach, Fla. 32931; James C. Wilson, III, 795 N. Tropical Trail, Merritt Island, both of Fla. 32953

[21] Appl. No.: 83,566

[22] Filed: Aug. 10, 1987

[51] Int. Cl.[4] ..... B63B 35/86

[52] U.S. Cl. ..... 441/79; 114/129; 114/140

[58] Field of Search ..... 441/79; 114/126, 129, 114/140

[56] References Cited

U.S. PATENT DOCUMENTS 4,044,416 8/1977 Brewer et al. ..... 441/79

FOREIGN PATENT DOCUMENTS 3248580 7/1984 Fed. Rep. of Germany ..... 114/126
2516472 5/1983 France ..... 441/79
82/01694 5/1982 World Int. Prop. O. ..... 441/79
85/01027 3/1985 World Int. Prop. O. ..... 114/140

OTHER PUBLICATIONS

"Windsurf", magazine, Oct. 1986, pp. 54, 55 and 63, Fin Futures and the Forefin.

"The Story on Fins", Tom James, Wind Rider Magazine vol. 6, Issue 4, Jul., 1987, pp. 91–100.

*Primary Examiner*—Sherman D. Basinger
*Assistant Examiner*—Thomas J. Brahan
*Attorney, Agent, or Firm*—Macdonald J. Wiggins

[57] ABSTRACT

A fin for a sailboard has a pair of high aspect ratio foils disposed in tandem in which the trailing edge of the forward foil is spaced apart from the leading edge of the aft foil. The fin permits high speed and rapid maneuvering without ventilation and stalling by reducing spanwise flow of water and loss of laminar flow at high angles of attack.

6 Claims, 1 Drawing Sheet

SAILBOARD FIN

BACKGROUND OF THE INVENTION

1. Field of the Invention

The present invention relates to sailboard fins, and more particularly to an improved fin having a pair of foils in tandem.

2. Description of the Prior Art

Within the past few years, the sport of windsurfing has become very popular. A board, similar to a surfboard, is utilized with a sail structure attached to the upper deck of the board. The board sailor stands on the board and grasps a frame attached to the sail support. The sailor thereby controls the position of the sail with respect to the wind direction and the board to sail in a desired path. Speeds on the order of 35 knots are achieved with current equipment and speed sailing competition is popular. Another aspect of windsurfing involves a variety of sharp turning maneuvers such as performed in slalom racing and waveriding (surfing), and jumping in which the entire board leaves the water.

A key element of the sailboard is a fin which projects downward from the underside and at the rear of the board. The fin is a small foil having cambered surfaces. The sail produces a tendency to move the board sideways through the water. The purpose of the fin is to counteract the sail's force to produce a forward motion of the board. The force produced by a foil moving through a fluid can be expressed mathematically as $$F_L = \frac{C_L d A v^2}{2}$$

where $F_l$ is the lifting force of the foil, $C_L$ is the coefficient of lift of the foil, d is the density of the fluid.

A is the area of the foil, and v is the velocity of the foil relative to the fluid.

$C_L$ is a function of the angle of attacke of the foil, and its configuration. For a fixed shape foil and angle of attack, the force is seen to be proportional to the area, to the fluid density, and to the velocity squared. As will be recognized, a small fin can counteract the force of a large sail due to the large difference in densities between air and water. Another consideration is the velocity since the force increases by the square of the velocity.

Prior art fins have been constructed having a wide variety of shapes. The span is the length of a fin from the tip to the root or base and the chord length is the width at the root. Generally, the span is long relative to the chord length. The span length to chord length is termed the aspect ratio. A low aspect ratio will permit a larger area for a given span. A high aspect ratio, of course, requires a greater span to obtain the same area. Fins generally are swept back, having the tip behind the base.

A phenomenum known as "spinout" is common with conventional high aspect ratio fins commonly used for high speeds and sharp maneuvering. There appear to be two actions responsible for spinout: stall and ventilation. Stall occurs when the angle of attack is excessive, producing turbulence in the flow of water across the fin and loss of lift. Ventilation occurs when air is drawn from the surface of the water into the low pressure or lifting region of the fin and may be due to spanwise flow of water. That is, water tending to flow from root to tip will tend to draw the air spanwise under certain conditions.

Spanwise flow is highly dependent upon the design parameters of a fin such as the amount of taper of the foil, the sweep, the aspect ratio, and the thickness. Spanwise flow has been reduced in some fins by using a cutout at the root which produces a reverse taper of the fin. However, there is a loss of efficiency with such planforms.

There is a need for a fin design which will avoid stall at large angles of attack, will minimize ventilation, and will have a large area while maintaining a high aspect ratio to reduce spanwise flow, yet which will maintain high efficiency.

SUMMARY OF THE INVENTION

The present invention is a fin for a windsurfing board which is suitable for high speed and radical maneuvering without stalling and ventilation. The fin comprises a pair of foils in tandem having a first high asepct ratio forward cambered foil and a second high aspect ratio rearward foil. The spacing between the first and second foils may be on the order of one-sixth to one-fourth the foil root width. A positive sweep in which the tip is behind the base or root is preferred.

The tandem positioning of the two foils permits the water flow to be maintained around the forward foil since the gap allows laminar flow through the gap to continue even at high angles of attack. The high aspect ratio of the individual foils reduce spanwise flow. Since ventilation requires a spanwise flow to draw air along the lifting surface of the foil, ventilation is avoided. Thus, spinout is greatly reduced. Water may also flow via the gap for large angles of attack, thereby reducing stalling of the fin.

Another feature of the fin is a foil thickness to chord length ratio greater than generally used in high performance fins, resulting in a further reduction in spanwise flow and improved high angle of attack performance.

As will be recognized, the invention provides a large area yet maintains a laminar flow at a much larger angle of attack than a single foil of the same area.

It is therefore a principal object of the invention to provide a fin for a sailboard having a pair of tandem foils in which each foil has a high aspect ratio.

It is another object of the invention to provide an improved fin for a sailboard which will minimize ventilation due to spanwise fluid flow.

It is still another object of the invention to provide an improved fin for a sailboard having a pair of tandem foils in which each foil has a high aspect ratio and which will maintain laminar flow at a greater angle of attack than a single foil having the same total area and span length.

These and other objects and advantages of the invention will become apparent from the following detailed description when read in conjunction with the drawings.

DETAILED DESCRIPTION OF THE PREFERRED EMBODIMENT

Figure 1:
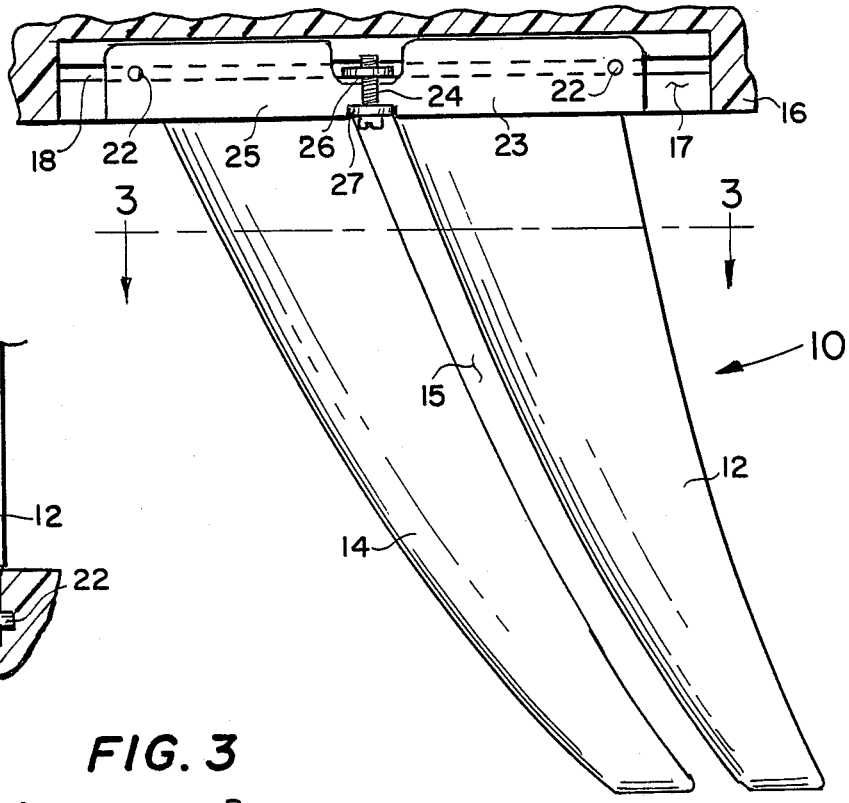
FIG. 1 is a side view of a fin in accordance with the invention.
Figure 2:
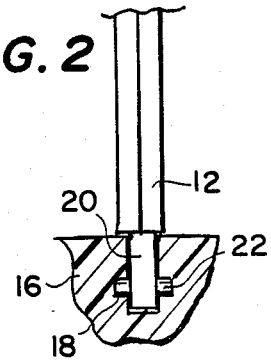
FIG. 2 is a cross-sectional view of the fin attachment box of FIG. 1 showing a partial view of the fin.

Referring first to FIG. 1, a fin shown generally at 10, is seen in side view. Fin 10 includes a forward foil 14 and a rearward foil 12 having a gap 15 therebetween. Gap 15 may have a width on the order of one-sixth to one-fifth of the chord at the root of foil 14. At the root or base of foil 14 is base 25 and at the root of foil 12 is base 23. As best seen in FIG. 2, base 23 is disposed in a slot 17 formed in box 16 which is disposed in the board with which the fin 10 is to be used. Box 16 is essentially standard throughout the board industry and includes a pair of grooves 18 in either sidewall of slot 17. Base members 23 and 25 each have a pin 22 inserted therethrough which engages grooves 18 in box 16.

Fin 10 is locked in place in box 16 by means of a threaded plate 26, square washer 27, and screw 24. Plate 26 engages grooves 18 and tightening screw 24 as shown in FIG. 1 securely locks the two bases 23 and 25 together in box 16.

Figure 3:
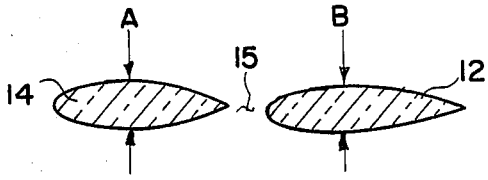
FIG. 3 is a cross-sectional view through the plane 3—3 of FIG. 1.

As seen in the cross-sectional view in FIG. 3 through plane 3—3 of FIG. 1, foils 14 and 12 have symmetrical cambers to provide a necessary lifting force to the right or left depending upon the angle of attack. As will be understood, the two foils 14 and 12 will normally move through the water with a certain angle of attack depending upon the wind and maneuver being performed. Therefore, there is created a low pressure region around the camber of the surface toward which the force is directed. Each foil may have a grater thickness A than a single foil having the same total area thereby improving the stall performance.

Figure 4A:
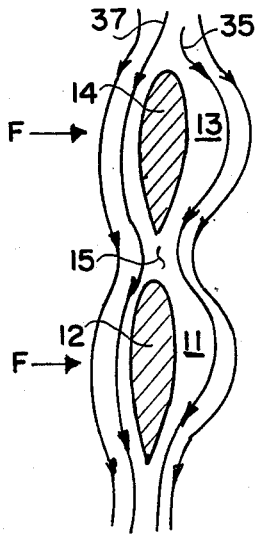
FIG. 4*a* shows a cross-sectional view of the fin of FIG. 1 having a low angle of attack and laminar flow of the water.
Figure 4B:
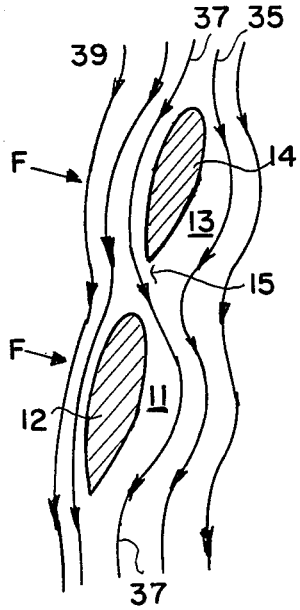
FIG. 4*b* is the fin of FIG. 4*a* at a high angle of attack showing how laminar flow is maintained.

Turning to FIGS. 4*a* and 4*b*, the action of the fin 10 is shown. FIG. 4*a* shows a normal laminar flow of water around foils 14 and 12 with a low angle of attack. Flow line 35 and 37 along the right surfaces of foils 14 and 12 are distorted producing low pressure areas 13 and 11. This action produces lift to the right as indicated by the arrows F. Flow lines 39 along the left side of foils 14 and 12 will be essentially laminar.

FIG. 4*b* illustrates the flow during a high angle of attack which would tend to produce a lifting force to the right. With a conventional single foil fin, a high angle of attack causes loss of laminar flow and turbulence will occur, for example where flow line 35 would diverge from the right surface of foil 12. However with the double foil fin 10 of the invention, the water flow indicated by flow line 37 is provided a path via gap 15 and laminar flow will be maintained over the right surface of foil 12. Water flow 39 over the left surfaces of foils 14 and 12 will be laminar. As will now be recognized, this action will prevent stalling at high angles of attack. Thus, the two foils 12 and 14 provide the necessary area to counterbalance the force on the sail, and provides gap 15 to maintain laminar flow and prevent stalling at a much greater angle of attack then is possible with a single foil fin having the same surface area.

It is also to be understood that the point of maximum thickness of the foil with respect to the leading edge may be varied depending upon the sailboard characteristics desired by the user.

When the requirement is for a greater stability at less than high speed, it is desirable to increase the fin area without creating stall and ventilation characteristic. The rear foil design of FIG. 5 satisfies this requirement. The rear foil 12 of FIG. 1 is replaced with foil 28 having the same span but a greater chord length. To maintain a short chord length at the root, a cutout 29 is provided. The cutout also produces less sweep, reducing spanwise flow.

Figure 5:
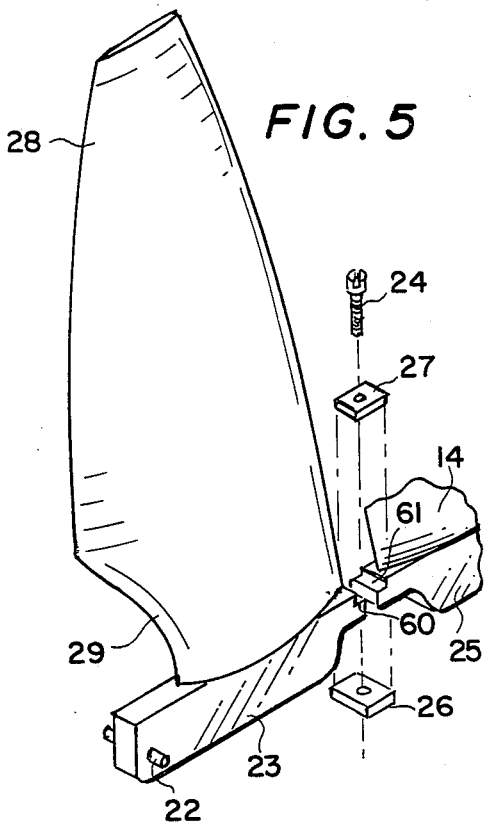
FIG. 5 is a perspective view of an alternative rear foil for the fin of FIG. 1 having a greater area, a reduced sweep, and a cutaway portion at the root thereof.

Additional details of base 23 may be seen in FIG. 5. A notch at the forward end thereof mates with a similar notch 31 at the rearward end of base 25 of FIG. 1. Rectangular washer 27 fits into notches 30 and 31 and is locked in place by tightening of screw 24 engaged with bar 26, which is disposed in grooves 18 of box 16.

Although the invention has been disclosed with reference to a specific structure, it will be evident that various shapes, spacings, mounting bases and the like of the exemplary structure can be modified without departing from the spirit and scope of the invention.

I claim:

1. A sailboard fin for a sailboard subject to high speed and rapid maneuvering, said fin minimizing spinout of said sailboard, comprising:

(a) a forward cambered foil having
  (i) a high ratio of span length to chord length,
  (ii) a tip portion,
  (iii) a root portion,
  (iv) a base attached to said root portion, said base disposed in a sailboard fin box,
  (v) a leading edge and a trailing edge, and
  (vi) said tip portion disposed rearwardly with respect to said root portion;

(b) a rearward cambered foil having
  (i) a span length essentially equal to the span length of said forward foil,
  (ii) a high ratio of span length to chord length,
  (iii) a tip portion,
  (iv) a root portion having a chord slightly greater than the length of the cord of said forward foil root portion,
  (v) a leading edge and a trailing edge;
  (vi) a base attached to said root portion, said base disposed in said sailboard fin box aft of said first fin, said leading edge spaced apart from said first foil trailing edge to produce an narrow gap therebetween, and
  (vi) said tip portion disposed rearwardly with respect to said root portion; and (c) clamping means for securing said first and second foils in said sailboard fin box in said spaced apart relationship.

2. A split sailboard fin for installing in a sailboard fin box comprising:

a forward foil having a first root portion, a high aspect ratio, and a first trailing edge;

a rearward foil having a second root portion having a chord length slightly greater than said first root portion and having a span essentially the same length as the span of said forward foil, a high aspect ratio, and a first leading edge, said rearward foil disposed directly aft of said forward foil to form a gap between said first trailing edge and said first leading edge, the width of said gap being in the range of one sixth to one fifth the length of the chord at said first root portion of said forward foil; and means for fastening said fin in said fin box.

3. A fin as recited in claim 2 in which said forward foil includes a tip portion and a root portion, said tip portion disposed rearwardly with respect to said root portion.

4. The fin as recited in claim 3 in which said rearward foil includes a tip portion and a root portion, said tip portion disposed rearwardly with respect to said root portion.

5. The fin as recited in claim 2 in which the width of said gap is essentially uniform along the spans of said forward and rearward foils.

6. A split sailboard fin for installation in a sailboard fin box comprising:

a forward foil having a high aspect ratio, a first leading edge, a first trailing edge, a root portion and a tip portion;

a rearward foil in tandem relationship with said forward foil, said rearward foil having a high aspect ratio and a second leading edge spaced slightly apart from said first trailing edge of said forward foil, said rearward foil having a tip portion immediately adjacent the tip portion of said forward foil, and a root portion, said root portion having a cutout in the trailing edge thereof for reducing the sweep of said rearward foil; and locking means for fastening said forward and rearward foils in said fin box.

* * * * *